US007281300B2

(12) United States Patent
Andersen et al.

(10) Patent No.: US 7,281,300 B2
(45) Date of Patent: Oct. 16, 2007

(54) HINGE AND USE THEREOF

(75) Inventors: Finn Andersen, Ry (DK); Henrik L. Pedersen, Sorring (DK); Glenn Højmose, Silkeborg (DK)

(73) Assignee: Baby Dan A/S, Lasby (DK)

( * ) Notice: Subject to any disclaimer, the term of this patent is extended or adjusted under 35 U.S.C. 154(b) by 0 days.

(21) Appl. No.: 10/540,928

(22) PCT Filed: Dec. 22, 2003

(86) PCT No.: PCT/DK03/00928

§ 371 (c)(1),
(2), (4) Date: Sep. 26, 2005

(87) PCT Pub. No.: WO2004/059113

PCT Pub. Date: Jul. 15, 2004

(65) Prior Publication Data

US 2006/0123597 A1 Jun. 15, 2006

(30) Foreign Application Priority Data

Dec. 30, 2002 (DK) ..... BA 2002 00414

(51) Int. Cl.
*E05D 11/06* (2006.01)

(52) U.S. Cl. ..... 16/342; 16/254; 16/260; 16/386; 16/374

(58) Field of Classification Search ..... 16/342, 16/380, 382, 386, 383, 230–232, 254, 257, 16/260, 265, 268, 270, 374
See application file for complete search history.

(56) References Cited

U.S. PATENT DOCUMENTS 1,294,044 A 2/1919 Buckwalter et al.
4,847,950 A * 7/1989 Coleman ..... 16/363
4,937,916 A * 7/1990 Redman ..... 16/243
4,987,639 A * 1/1991 Baiuley et al. ..... 16/445
5,040,268 A * 8/1991 Knurr ..... 16/261

(Continued)

FOREIGN PATENT DOCUMENTS

DE 8812589 1/1989

(Continued)

*Primary Examiner*—Jack W. Lavinder
*Assistant Examiner*—Michael J. Kyle
(74) *Attorney, Agent, or Firm*—Dykema Gossett PLLC

(57) ABSTRACT

A hinge for a child safety barrier, consisting of first (1, 9) and second (2, 10) bracket parts, wherein the first bracket part is formed with a pin (4) whose free end is formed with a shoulder (5). The second bracket part (2, 10) is formed with a hole (7) with two sections, where the first section has a larger diameter than the second section. This provides an edge between the two sections, which, together with the shoulder (5) of the pin, serves as a lock between the two bracket parts. If the length of the pin is larger than the length of the section of the smallest diameter, then the two hinge parts may be displaced relative to each other in the direction of the pin, which is an advantage when the hinge is used in connection with child safety barriers. The two bracket parts of the hinge are formed with respective locking parts which cooperate such that when one bracket part is displaced relative to the other bracket part, the bracket parts may be rotated relative to each other.

4 Claims, 1 Drawing Sheet

U.S. PATENT DOCUMENTS

| | | | | | |
|---|---|---|---|---|---|
| 5,088,154 | A * | 2/1992 | Ishikawa | 16/252 |
| 5,127,132 | A | 7/1992 | Karlin | |
| 5,396,732 | A * | 3/1995 | Andersen | 49/55 |
| 5,561,886 | A * | 10/1996 | Flamme | 16/265 |
| 5,564,163 | A * | 10/1996 | Lowry et al. | 16/342 |
| 5,669,106 | A * | 9/1997 | Daoud | 16/266 |
| 6,701,573 | B1 * | 3/2004 | Ciavarella et al. | 16/266 |
| 6,715,182 | B2 * | 4/2004 | Cheng | 16/280 |
| 6,804,862 | B2 * | 10/2004 | Miller | 16/386 |

FOREIGN PATENT DOCUMENTS

| | | | |
|---|---|---|---|
| EP | 0 178 211 | | 4/1986 |
| EP | 0 196 435 | | 10/1988 |
| EP | 359857 | A1 * | 3/1990 |
| EP | 531216 | A1 * | 3/1993 |
| FR | 2 538 838 | | 7/1984 |
| GB | 2115477 | | 9/1983 |
| GB | 2259946 | A * | 3/1993 |
| JP | 06146696 | A * | 5/1994 |
| WO | 97/40253 | | 10/1997 |

* cited by examiner

HINGE AND USE THEREOF

BACKGROUND OF THE INVENTION

1. Field of the Invention

The invention relates to a hinge consisting of first and second bracket parts, wherein the first bracket part is formed with a pin, while the second bracket part is formed with a hole to receive the pin, where the hole is made in two sections, one section having a larger diameter than the other section.

2. The Prior Art

Such hinges are used in many connections, such as in the mounting of doors of the conventional type. In addition, such hinges are used for doors in child safety barriers, playpens and like. In connection with the last-mentioned use, the hinges are frequently made of plastics, and instead of the pin a screw in used for the joining of the two bracket parts of the hinge. Since doors for child safety barriers are to be protected against unintentional opening, they are constructed in some cases such that a vertical lifting movement of the door must be carried out before it can be opened, which requires that the hinge of the door is prepared for this.

An example of such a door structure is known from WO 97/40253. This door structure has a hinge arranged such as to allow the door to be opened or closed after a vertical movement of the door has been carried out. The hinge is composed of several parts, including a bolt, in a rather complicated manner.

A hinge of the kind defined in the introductory part of claim 1 is known from U.S. Pat. No. 5,127,132. This hinge construction is not intended to be used such that the two bracket parts of the hinge can be moved vertically relative to each other.

Accordingly, an object of the invention is to provide a hinge which is relatively inexpensive to manufacture, where the two bracket parts of the hinge can be moved vertically relative to each other.

SUMMARY OF THE INVENTION

The object of the invention is achieved by a hinge of the type defined in the introductory portion of claim 1, which is characterized in that a shoulder is provided on the pin, and that the section of the hole of the largest diameter is longer than the section of the smallest diameter. The hinge may hereby be made in two parts, with the shoulder serving as a lock which adjoins an edge defined by the area where the two sections of the hole meet.

Further, it is possible to move the brackets relative to each other, without the risk of separating the bracket parts from each other.

When the shoulder is provided on a portion of the surface of the pin, and it is dimensioned to pass the section of the smallest diameter by pressure, a hinge is provided which may be assembled by pushing the pin into the hole by a force which is so great that the two parts of the hinge cannot readily be separated after assembly.

When the shoulder is provided near the free end of the pin, it is possible, by suitable selection of dimensions of the two sections in the second bracket part, to make a hinge where movement of the pin is allowed or not allowed.

For use where locking of the rotation of the bracket parts relative to each other is desired, it is an advantage if the first bracket part is formed with a locking part which cooperates with a locking part on the second bracket part.

These locking parts may expediently be constructed so that the locking part is formed by a box-shaped part which is terminated on a portion of its lower side by a plate-shaped part having larger horizontal dimensions than the box-shaped part, and that the plate-shaped part has a free surface which is flush with one free end of the box-shaped part, and so that the locking part on the second bracket part is formed by a box-shaped part which is terminated at its one end by a block-shaped part having larger horizontal dimensions than the box-shaped part, and that the block-shaped part has a free surface.

When the bracket parts are made of the same material, e.g., hard plastics, it is ensured that the manufacturing costs of the brackets may be kept reasonably low. As mentioned, the invention also relates to use of the hinge.

The invention will now be explained more fully with reference to the drawings.

BRIEF DESCRIPTION OF THE DRAWINGS

FIG. 5 shows the hinge of FIG. 4, seen obliquely from the side with the bracket parts in a locked state, while

DETAILED DESCRIPTION OF THE PREFERRED EMBODIMENTS

Figure 1:
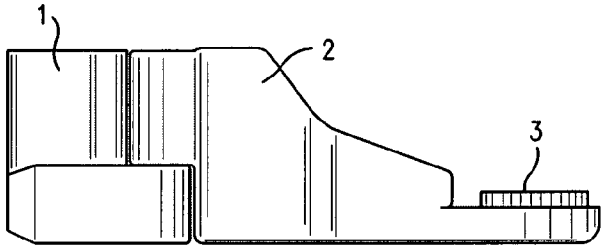
FIG. 1 shows a hinge according to the invention consisting of first and second bracket parts.
Figure 2:
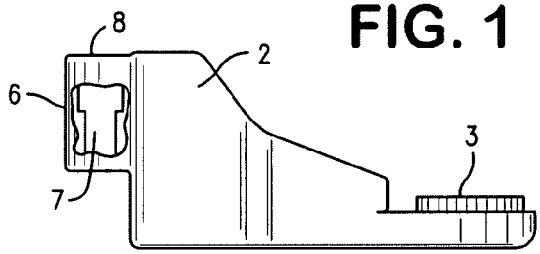
FIG. 2 shows the second bracket part of FIG. 1, with a portion broken away to show a section of the hole therein.
Figure 3:
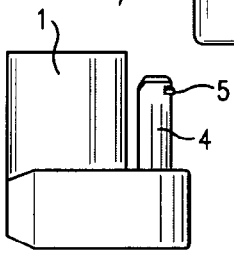
FIG. 3 shows the first bracket part of FIG. 1.

In FIGS. 1 to 3, the numeral 1 designates a first bracket part, while 2 designates a second bracket part which has a toothed rim 13 capable of cooperating with another tooth engagement (not shown), and the two tooth engagements may be positioned relative to each other by vertical displacement, e.g., as explained in connection with the safety barrier described in WO 00/11301. The first bracket part 1, cf. FIG. 3, has a pin 4 adapted to engage a hole 7 on the second bracket part 2. The pin 4 moreover has a shoulder 5, as will be seen in FIG. 3.

The hole 7 in bush 6 is formed with two sections see (FIG. 2), where one section has a larger diameter than the other section. The section of the largest diameter is disposed at the end designated 8 in FIG. 2. The section of the smallest diameter has a diameter which allows the shoulder 5 on the pin 4 to pass only when it is subjected to a force, while the hole of the largest diameter allows the pin 4 with the shoulder 5 to move freely.

The function of the hinge will be explained now.

When the first 1 and the second 2 bracket parts are assembled, the pin 4 with the shoulder 5 on the first bracket part 1 is pressed into the hole 7 in the section of the smallest diameter. The two bracket parts are hereby locked together, but since the shoulder 5 is pressed into the section of the largest diameter, the two bracket parts may be moved relative to each other by rotation. If, moreover, the section of the smallest diameter has a length shorter than the pin 5, the two bracket parts of the hinge may be displaced mutually in the direction of the pin in addition to being rotated relative to each other, as the pin with the shoulder when displaced just slightly into the hole reaches the section of the largest diameter.

Vertical displacement of the second bracket part 10 in the direction of the arrow 21 causes the block-shaped part 16 to be displaced relative to the plate-shaped part 13, which means that the bracket parts may rotate relative to each other, as indicated by the arrow 22.

Figure 4:
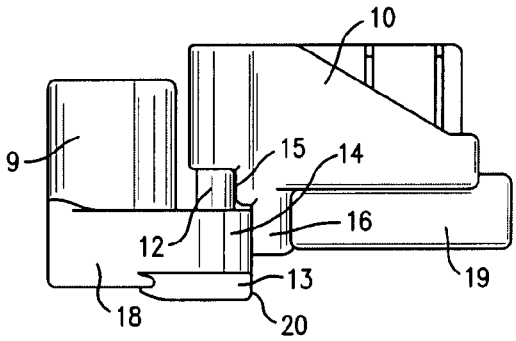
FIG. 4 shows a hinge in a second embodiment where the bracket parts are displaced relative to each other.

Such a displacement of the bracket parts relative to each other is shown in FIG. 4, which shows a hinge which is basically constructed like the hinge of FIGS. 1-3, but now provided with a locking function, as will be explained below.

Figure 5:
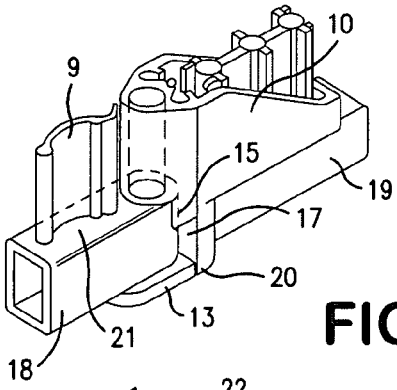
Figure 6:
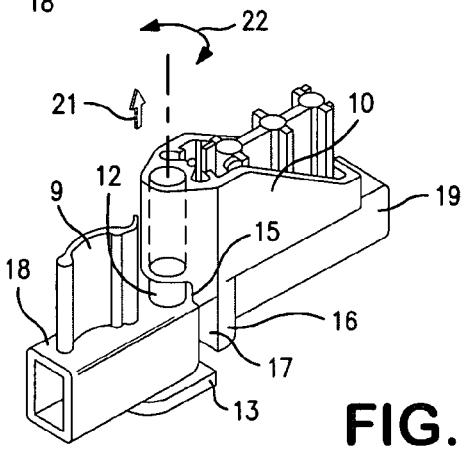
FIG. 6 shows the hinge of FIG. 5 in a non-locked state.

In FIGS. 4-6, the numeral 9 designates a first bracket part, while 10 designates a second bracket part.

The first bracket part 9 is formed by a box-shaped part 18 which, on a portion of its lower side, is formed with a plate-shaped part 13 having horizontal dimensions which are larger than the box-shaped part. The free end 20 of the plate 13 is rectangular. The plate-shaped part 13 constitutes a first part of a locking mechanism which cooperates with a locking mechanism on the second bracket part 10.

As will be seen in FIGS. 5 and 6, also the second bracket part 10 is formed by a box-shaped part 19 which, on a portion of its lower side, is formed with a block-shaped part 16 which also has horizontal dimensions larger than the box-shaped part 19. The free end of the block-shaped part is formed as a square with a free surface 17. Finally, the second bracket part 10 is formed with two symmetrical collars 15 whose free ends are terminated a distance downwards by the free surface 17 so as to create a gap between the collars and the plate-shaped part 13 on the first bracket part 9.

It will now be explained how the hinge of FIGS. 4-6 works:

FIG. 5 shows the hinge in a locked state, where the locking function is provided by the plate member 13, with its free end 20 adjoining the free surface 17 of the block-shaped part 16.

Vertical displacement of the second bracket part 10 in the direction of the arrow 20 causes the block-shaped part 16 to be displaced relative to the plate-shaped part 13, which means that the bracket parts may rotate relative to each other, as indicated by the arrow 22.

In the rotation, the free surface 15 of one of the collars will slide on the upper surface of the box-shaped part 18, thereby providing stable fixing of the parts relative to each other.

The hinge described may advantageously be used in connection with the safety barrier described in WO 97/40253, in which the safety barrier has to be lifted before it may be rotated and thereby opened and closed, respectively.

The invention claimed is:

1. A hinge consisting of a first bracket part and a second bracket part, wherein the first bracket part is formed with a pin, while the second bracket part is formed with a hole to receive the pin, where the hole is made in two sections, one section having a larger diameter and the other section a smaller diameter, and where a shoulder is provided on a portion of the surface of the pin, and where the section of the hole of the larger diameter is longer than the section of the smaller diameter, and wherein the shoulder is provided near a free end of the pin, said shoulder being dimensioned to pass the section of the smaller diameter by pressure, said first bracket part being formed with a first locking part which cooperates with a second locking part on the second bracket part, wherein the first locking part is formed by a first box-shaped part which is terminated on a portion of a lower side by a plate-shaped part having larger horizontal dimensions than the first box-shaped part, and the plate-shaped part has a free surface which is flush with one free end of the first box-shaped part, and the second locking part is formed by a second box-shaped part which is terminated at its one end by a block-shaped part having larger horizontal dimensions than the second box-shaped part, and the block-shaped part has a free surface, said free surface of the plate shaped part adjoining the free surface of the blocked-shaped part when the locking parts are locked together.

2. A hinge according to claim 1, wherein the first and second bracket parts are made of the same material.

3. A hinge according to claim 2, wherein the material is hard plastic.

4. A child safety barrier which includes the hinge defined in claim 1.

* * * * *